United States Patent [19]

Brueske

[11] 4,068,446

[45] Jan. 17, 1978

[54] MOVING WORK STATION FOR USE IN CONSTRUCTING A BUILDING ROOF

[75] Inventor: Ralph H. Brueske, Kansas City, Mo.

[73] Assignee: Butler Manufacturing Company, Kansas City, Mo.

[21] Appl. No.: 755,848

[22] Filed: Dec. 30, 1976

[51] Int. Cl.[2] ..... E04B 1/00; E04G 21/00

[52] U.S. Cl. ..... 52/747; 52/122; 52/143; 182/45; 214/1 R

[58] Field of Search ..... 52/747, 748, 749, 143, 52/122; 214/1 R, 1 H, 1 SW, 1 B, 1 BB, 1 D, 1 N, 330, DIG. 7; 182/36, 45, 63, 222; 104/96, 102, 48, 1 R

[56] References Cited

U.S. PATENT DOCUMENTS

| | | | |
|---|---|---|---|
| 1,016,935 | 2/1912 | Clark | 182/45 X |
| 2,231,560 | 2/1941 | Campion | 182/45 X |
| 2,814,533 | 11/1957 | Van Horn | 182/45 X |
| 3,379,281 | 4/1968 | Calletti et al. | 182/63 X |
| 3,410,428 | 11/1968 | Maher et al. | 214/1 R X |
| 3,601,947 | 8/1971 | Hurd | 52/748 X |
| 3,769,916 | 11/1973 | Hogan | 52/749 X |
| 3,842,934 | 10/1974 | Bartlett | 182/45 X |

*Primary Examiner*—J. Karl Bell
*Attorney, Agent, or Firm*—Shoemaker and Mattare, Ltd.

[57] ABSTRACT

A moving work station for use in placing roof panels on a building roof. The station includes a platform which has collapsible fences mounted thereon to insure the safety of workmen using the work station and has motive power means for moving the work station from location to location on a roof. Material handling means are mounted on the work station platform for moving roof panels and insulation onto the platform from locations on the roof, as well as for placing the insulation onto the roof. The material handling means also includes means for maintaining the insulation in position on the purlins until that insulation is secured thereto. A method of laying roof panels onto a building is also disclosed.

24 Claims, 6 Drawing Figures

MOVING WORK STATION FOR USE IN CONSTRUCTING A BUILDING ROOF

BACKGROUND OF THE INVENTION

The present invention relates to building construction, and, more particularly, to placing roofing on a building.

In constructing a roof, panels are generally wired or banded together in pallet form and usually contain between 15 and 30 panels per pallet. Workmen installing roof panels must carry or push the panels into the location whereat the panels are to be secured to the purlins.

When carrying out the construction of a roof, the workmen are exposed to high winds, as there is seldom any windbreakers around them. Thus, when carrying large or bulky materials, the men are in danger of being blown off balance and falling, or at least being cut by a panel. Often, very large panels require two or more men to move them. In such a situation, the many hazards of an unfinished roof are accentuated by the coordination of the effort required. On windy days, panels can act like sails, and accordingly, be very difficult and dangerous to handle.

The men often must walk on the purlins themselves or on unsecured roof panels. Either situation presents many possibilities for falls. Furthermore, the workmen are forced to walk on the insulation as they move about the roof when laying a roof panel into position to be secured to the roof. Such a situation presents many problems. For example, such contact may loosen that insulation and cause it to sag. Worse, the workmen no longer are able to see the exact position of the purlins, and hence can easily step between those purlins.

Heretofore, the workmen were only protected by hand lines or tag lines tied to building structural members. Such safety elements have many drawbacks. For example, heavy or bulky materials must be moved while one hand is used to hold onto the hand line, an awkward situation at best. The work is often slow, and on windy or gusty days, must be stopped entirely.

A further problem which causes much delay in constructing a roof arises when heavy roofing panels are required. The panels must be hoisted up to the final position almost individually, and then two or more men must work together to move the panels into the final location. Such a procedure is quite slow, and is also dangerous, as a panel being hoisted up through spaces defined between purlins may fall.

The device embodying the teachings of the present invention provides a moving work station which has means for protecting workmen and means for transporting heavy materials easily and quickly about a roof.

SUMMARY OF THE INVENTION

The device embodying the teachings of the present invention enables men to work safely on a roof even on windy and gusty days. Furthermore, materials can be deposited on a roof at a single location and moved as required.

A moving work station has a platform supported on the purlins by sets of wheels, with each set having one driven wheel so that the station moves under its own power. Fences which can be collapsed to permit material movement about the work station surround the platform to prevent workmen from falling off of the roof.

The work station has material handling means which includes elevatable outrigger arms for supporting work panels and roof insulation handling means. The insulation can be rolls of glass fiber and the insulation handling means includes means for supporting those rolls of glass fiber on stretcher arms for maintaining the insulation in a taut condition while it is being secured to the roof. The roof panels are supported on top of the stretcher arms and lowered into position thereby.

After the roof panel is properly secured, the stretcher arms are raised slightly, and the work station is moved backwards to the next work location. Rails can also be mounted onto secured panels so the work station can move on secured panels as well to complete the installation procedure.

The work station of the present invention therefore has means for protecting workmen from being knocked off of the roof by gusts of wind or from falling due to a misstep or other event causing loss of balance. The safety fences are also collapsible, and hence will not impede progress of the work by impairing movement of the men working on the work station.

As the work station moves under its own power, the heavy and/or bulky materials can be moved thereby to the work location. Thus, materials need not be hand carried from a central location to the work location. This, in inself, speeds up work, especially under windy conditions. The men need not step onto open purlins or onto unsecured panels or onto insulation, as they can move along while standing on the work station platform. Furthermore, very heavy materials can be easily moved using the work station.

The insulation is easily carried and positioned by the work station, and held in place in a taut condition until that insulation is properly secured to the purlins. Thus, gusts of wind or the normal pressures will not loosen insulation in some areas. Furthermore, as workmen need not leave the platform, there is no danger of stepping onto insulation and falling through the roof because a workman thought there was a purlin beneath his foot.

OBJECTS OF THE INVENTION

It is a main object of the present invention to provide a safe working area for workmen placing a roof on a building.

It is another object of the present invention to provide means for moving heavy and bulky materials on the roof of a building under construction.

It is a further object of the present invention to provide means for placing insulation onto a roof in an expeditious manner.

It is yet another object of the present invention to provide means for holding that insulation taut while that insulation is being secured in place.

It is still another object of the present invention to enable men to place roof panels without requiring those men to stand on purlins or on unsecured roof panels.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
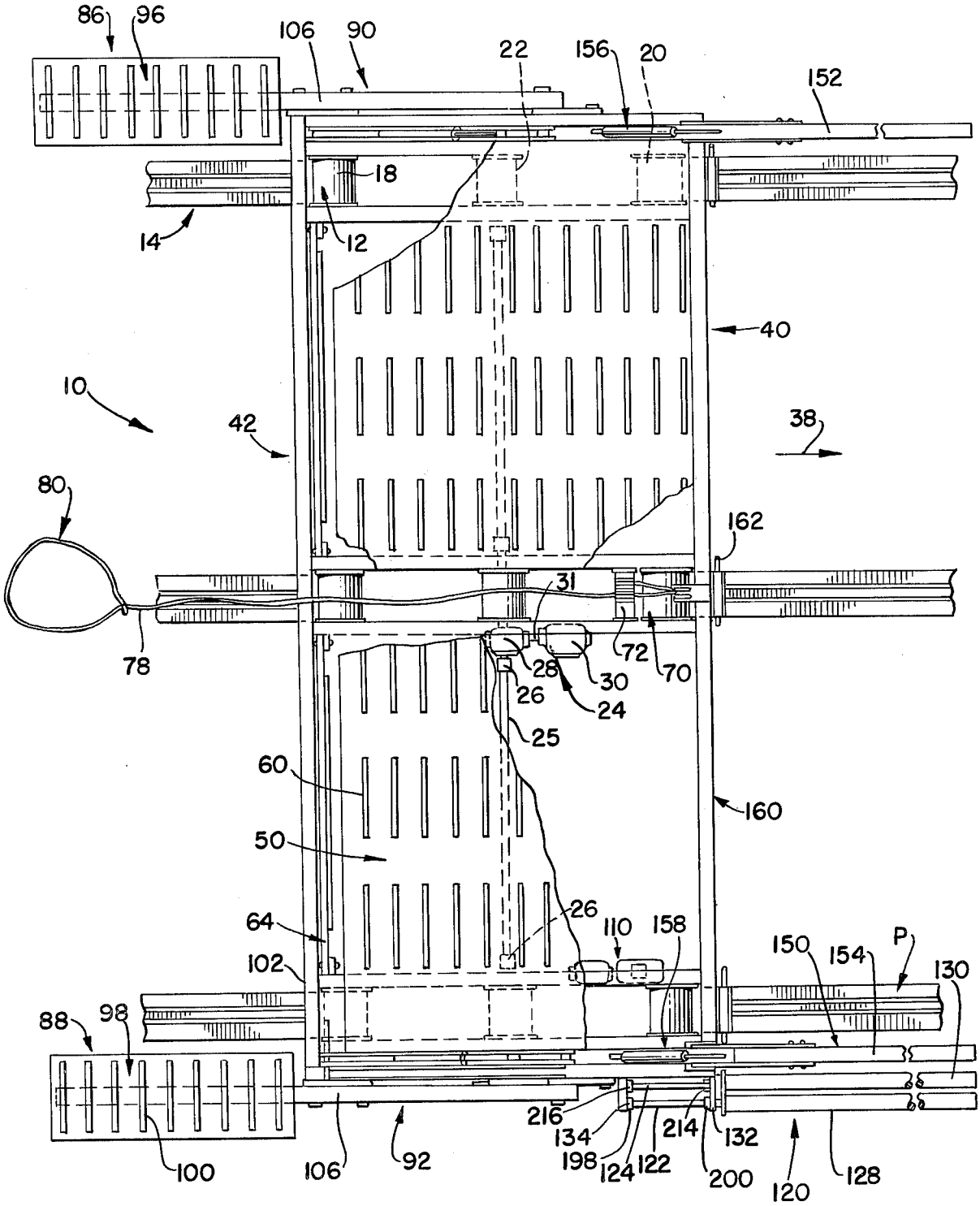
FIG. 1 is a plan view of the moving work station embodying the teachings of the present invention.

Shown in FIG. 1 is a moving work station embodying the teachings of the present invention. The work station is denoted generally by the numeral 10 and includes wheels 12 adapted and sized to ride on the tops of purlins 14 of a building under construction. The purlin system can be any suitable construction, such as a Landmark or a Widespan system used by Butler Manufacturing Company. The wheels are arranged in three sets of three wheels each, and each set includes a pair of idler wheels 18 and 20 with a drive wheel 22 positioned therebetween. The drive wheels 22 are each connected to a drive means 24 by a drive shaft 25 coupled to the wheels by a coupling 26 and to a gear reducer 28 which is driven by a motor 30 which can be electric, internal combustion, or any other suitable type, and is coupled thereto by a coupling shaft 31.

Each wheel has a pair of end rims 34 (FIG. 2) and a cylindrical body 36 having a length approximately equal to the width of a purlin top "T". The size of the wheels is selected so that the work station can move feeely over the purlins while being held securely thereon.

Figure 6:
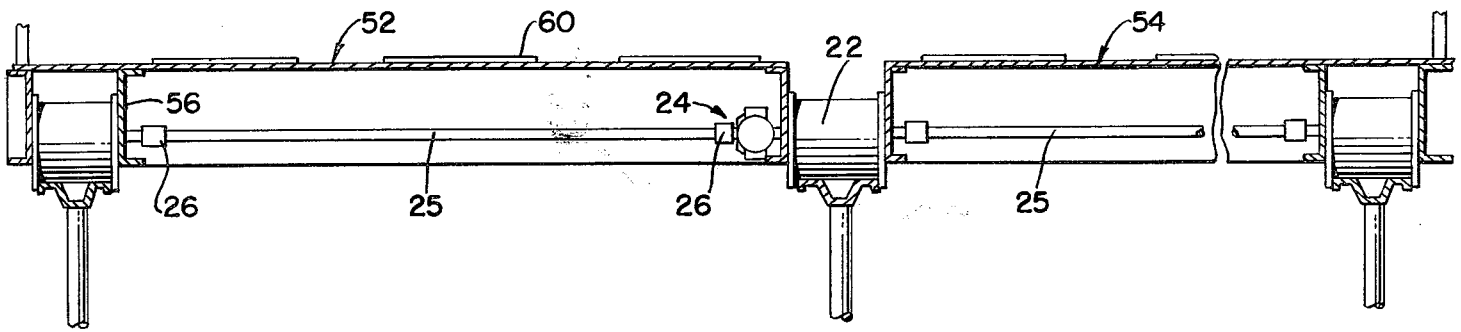
FIG. 6 is a sectional view taken along line 6—6 of FIG. 3.

The work station is intermittently driven by the drive means and, for the sake of convenience, the advancing direction of the work station is indicated by arrow 38. In the advancing direction, the work station has a fore-end 40 and an aft-end 42. A work platform 50 is in two coplanar sections 52 and 54 (FIG. 6) and has a plurality of brackets 56 upon which the wheels are rotatably mounted. The platform 50 spans the purlins and is mounted on the wheels for movement therewith. The work platform provides a walkway and a working area for workmen who are laying the building roof, and includes anti-slipping protrusions 60 to provide a skid-free surface which enables the workmen to get a firm foothold thereon. The foothold is one of the safety features of the work station and will be discussed in greater detail below.

The work station also includes a collapsible safety fence 64 with sections which can be located on the aft-end of the work station as well as on any and all sides thereof. The fences are set up to prevent the men from accidentally falling from the work station, but can be collapsed into a pocket to load materials onto the work station, or other such operation. The details of the fence will also be presented in greater detail below.

Work station 10 also includes a winch assembly 70 for moving heavy loads or bulky materials onto the platform. The winch assembly includes a take-up reel 72 driven by a suitable motor, or by hand, and has a drag line 78 connected thereto. As shown in FIG. 1, the drag line has a tie loop 80 on one end thereof which fits around material to be dragged onto the platform. The winch assembly therefore permits workmen to move heavy and/or bulky materials onto the platform from a central location in an easy and expeditious manner, as above-discussed.

Still referring to FIG. 1, it is seen that the work station also includes a pair of outrigger arms 86 and 88 each elevatably connected to one side of the work station by elevator linkages 90 and 92, respectively. The arms are located to be in spaced parallelism and move in unison to be in, and remain in, co-elevational positions. The arms lift materials into position for movement by workmen on the work station, and each includes lifting pallets 96 and 98, respectively, and each has anti-skid projections 100 thereon. The pallets are located adjacent the aft-end of the work station and are spaced apart from the aft-edge 102 thereof so that the pallets can freely move without interference with the platforms. As will be later discussed, the elevator linkages each include lever arms 106 connected to the pallet and to elevating means. The elevating mechanism also includes suitable motive means 110 which is connected to the elevating means to elevate the pallets when necessary.

Figure 2:
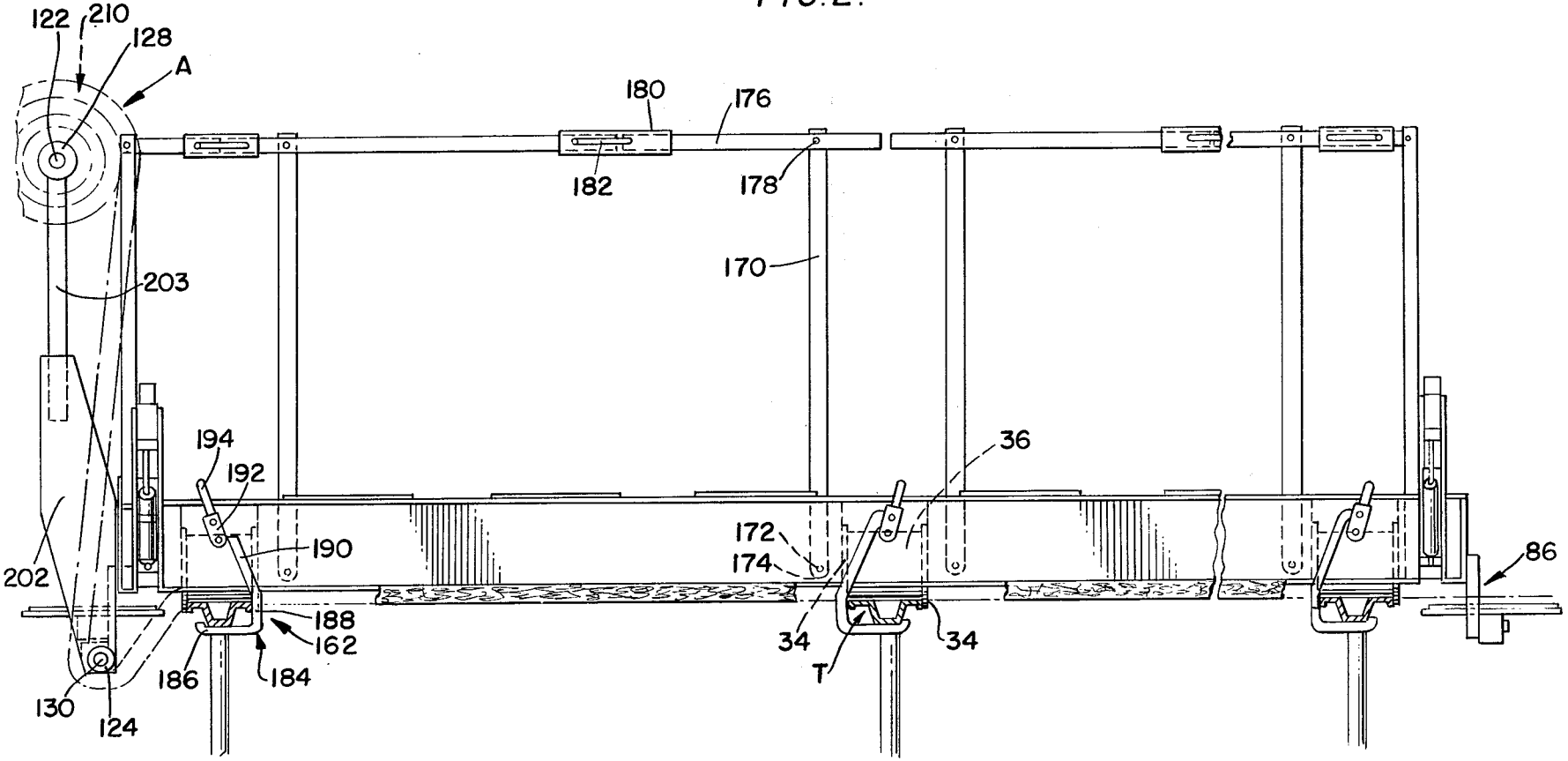
FIG. 2 is a front elevation view of the work station embodying the teachings of the present invention.

As shown in FIG. 2, the arms have a lowered position located beneath the plane of the purlin tops. In this position, the arms can be positioned beneath a load of materials to lift same in the manner of a forklift truck. As will be later discussed, the arms undergo a circular motion and therefore move the materials to a location above the work platform from the location adjacent the work station. By this movement, the materials can be loaded onto the platform by workmen without requiring those workmen to move off of the platform. The materials are lifted up and towards them by the outrigger arms.

Located adjacent the fore-end on one side of the work station is an insulation handling system 120 which includes a horizontal, forwardly extending supporting arm 122 located superjacent a guide bar 124 which is horizontal and is essentially co-extensive with the supporting arm. The insulation handling system is attached to the work station and includes rollers 128 and 130 rotationally mounted on the arm and bar, respectively, and are connected together by fore and aft linkages 132 and 134, respectively. An insulation roll is supported by the arm 122 and is wound about guide rolls 130 and thence stretched over the purlins.

An insulation stretcher mechanism 150 is located on the fore-end of the work station and includes a pair of spaced apart, parallel arms 152 and 154 each movably connected to the work station by elevating means 156 and 158, respectively. The stretcher arm 154 is located to be interjacent the guide roller 130 and a purlin, such as purlin "P", on which the work station is supported. The arm 154 stretches insulation, such as glass fiber, into a taut configuration and maintains that insulation in such a configuration while the insulation is properly attached to the purlins.

Located immediately adjacent the work station fore-edge 160 are a set of immobilizing clamps 162. The clamps can be either automatically or hand operated and each are adapted to releasably grasp a purlin to hold the work station immovably in position while the workmen complete their tasks at that position.

The above-discussed elements 11 cooperate to provide a safe work station which enables workmen to quickly assemble a roof structure using even very large and bulky panels. Such panels may be otherwise difficult, if not impossible, to handle on windy days, and work may have to cease for the sake of safety were it not for the work station here disclosed. Each of the elements are shown in the remaining figures, and will now be discussed in detail with reference to those figures.

Figure 5:
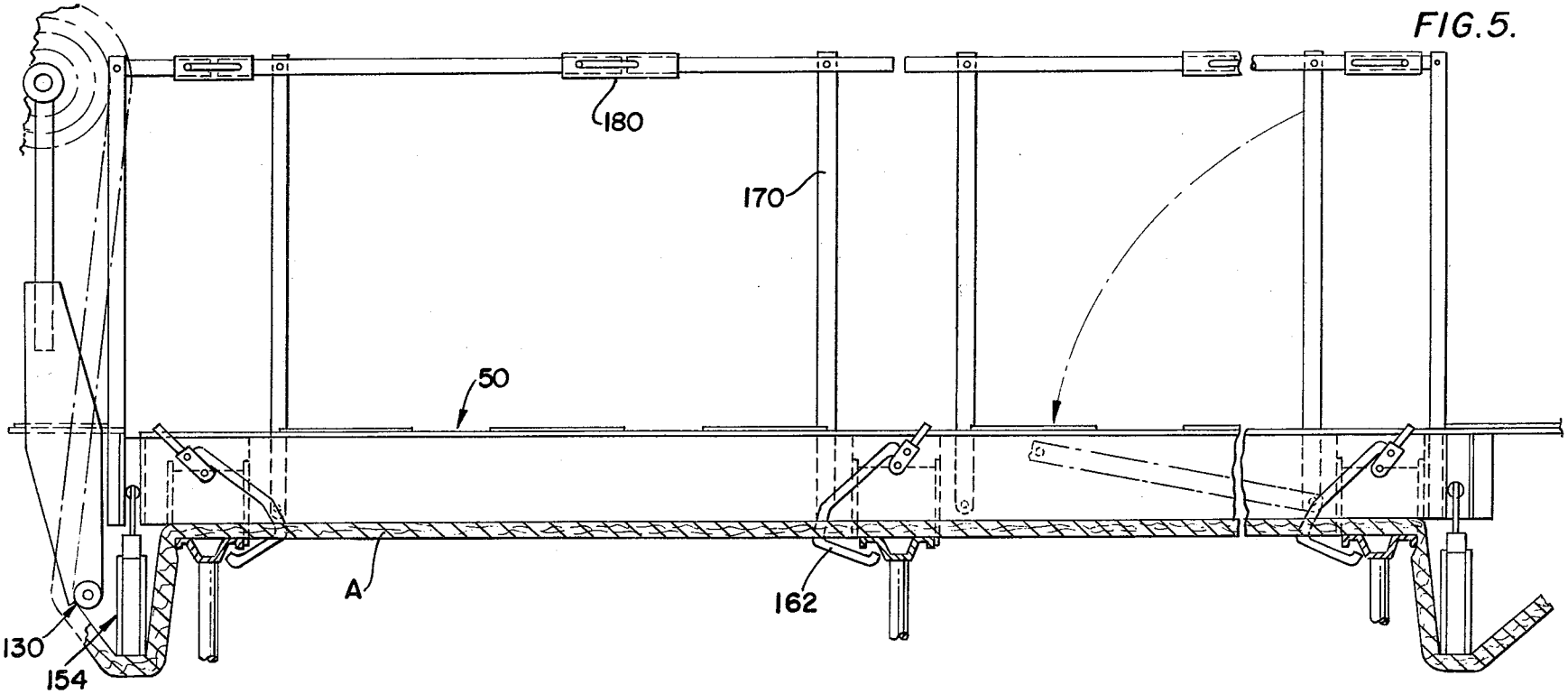
FIG. 5 is a front elevation of the moving work station with immobilizing clamps unlocked.

The safety fences are best shown in FIG. 2, and include a plurality of upright standards 170 pivotally connected at the lower end thereof to the platform by pivot pins 172 attached to brackets 174 mounted on the platform. The other ends of the standards are each pivotally connected to a horizontal safety rail 176 by pivot pins 178. The horizontal safety rail is formed of a plurality of separate members interconnected at the ends thereof by coupling members, such as member 180. Each coupling member has a locking means 182 thereon for releasably holding a pair of axially aligned rail members together. The entire safety fence is therefore collapsible by simply unlocking the coupled members and pivoting the upright standards until the horizontal rails and upright standards are positioned together next to the edges of the platform (FIG. 5).

Provision can also be made to store the collapsed safety fences adjacent the sides of the platform, or in grooves defined in the platform. In this manner, the collapsed fences will not become hazards over which a workman may trip. It is even possible to provide storage compartments on the sides of the platform or in the platform with covers which fit over the storage compartments. In such a case, the brackets will be mounted in the storage compartments. Alternatively the brackets themselves may be removable to completely remove the safety fences from the platform, if necessary.

The fence standards 170 can also each be comprised of a plurality of telescoping sections so that fences of various heights can be formed. The fences can also have a system whereby they can be automatically deployed. Such a system can be either electrical or mechanical, or the like.

FIG. 2 also shows the immobilizing clamps 162. These clamps each include a C-shaped body 184 having a horizontal portion 186 which fits underneath a purlin top and into contact with the undersurface thereof. The body 184 also includes a vertical section 188 having a length approximately equal to the thickness of the purlin top and connecting the horizontal section to a top section 190. The top section 190 has a bracket 192 attached thereto connecting a handle 194 to the clamp body. The brackets are pivotally mounted on the platform and are moved from an open position (FIG. 5) into a clamping position (FIG. 2) to immobilize the work station.

The insulation handling system is shown in FIGS. 1, 2, 3 and 5 and the supporting arm 122 is shown to be pivotally supported on upright mounting arm 134 by a joint 198 and to a mounting arm 132 by a rotatable bearing means 200. A link arm 202 has a mounting arm 203 on one end thereof and forms arm 132. Guide roller mounting arm 124 is connected to the arm 202 on the other end thereof. The guide roller 130 is transversely offset from the mounting roller 128 by the link arm 202, and insulation "A" supported on arm 122 in a roll 210 is wound around roller 130, then guided over the purlins as shown in FIG. 2. The guide roller 130 is positioned beneath the plane of the purlin tops so that the insulation will be stretched into a taut configuration when it is positioned on the purlins. The guide arm 124 is rotatably held on standard 132 by a coupling 214 and on standard 134 by a coupling 216. The link arm 202 and the support arm 203 can be tilted toward or away from the work station to compensate for various insulation materials, and the like.

Figure 3:
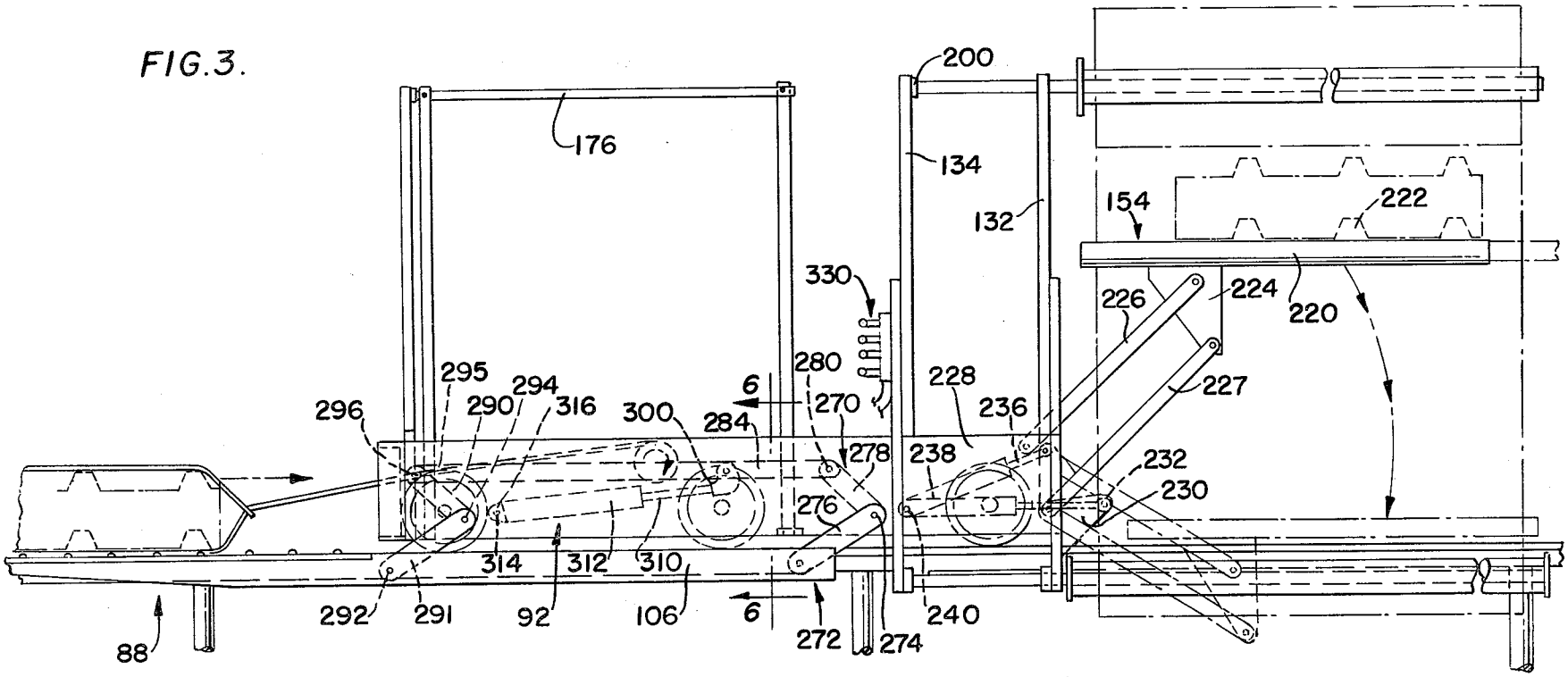
FIG. 3 is a side elevation view of the work station embodying the teachings of the present invention with an outrigger arm in a lowered position.

The insulation handling system also includes the stretcher mechanism 150 shown in the repose or retracted position in FIG. 2 and in the working position in FIG. 5. The clamping arm 154 is best shown in FIG. 3. As both clamping arms are identical, only clamping arm 154 will be described. Referring to FIG. 3, the arm 154 includes a horizontal member 220 having a ribbed member 222 on the upper surface thereof and a bracket 224 depending therefrom at one end thereof. Linking arms 226 and 227 are pivotally connected at one of the ends thereof to the bracket 224, and have the other ends thereof pivotally connected to a depending side skirt 228 of the platform.

A connecting link 230 has the ends thereof connected to the link arms and has a pivotal coupling 232 mounted thereon to pivot the linkage. The pivotal coupling is connected to one end of a ram 236 of a hydraulic cylinder 238 which is also pivotally mounted by a pivot pin 240 to the side skirt 228.

As the cylinder is actuated, the ram extends and/or retracts accordingly and the pivotal coupling 232 transforms the rectilinear motion of the ram into circular motion to cause both the cylinder and the link arms 226 and 227 to tilt either upwardly into the position shown in full lines in FIGS. 2 and 3, or downwardly into the position shown in phantom lines in FIGS. 3 and 5.

As shown in FIG. 5, the lowermost position of the arm 154 is beneath the plane of the roller 130 and hence the arm 154 further stretches insulation A into a taut configuration. As will be later discussed, the arms 152 and 154 are used to lower roof panels into place and are held in the lowered position until the insulation is properly secured to the purlins, whereupon the arms can be released from the insulation, if so desired. These arms can also be used to raise materials which have been placed on the purlins in much the same manner as the outrigger arms because of the positioning thereof beneath the plane of the purlin tops. The arms 152 and 154 can also be used to elevate or lower other roofing materials into desired positions. The materials need only be supported across the arms and the elevating mechanism actuated. The arms move in unison and thus the material will remain securely held in place on the arms by the ribbed members 222.

Figure 4:
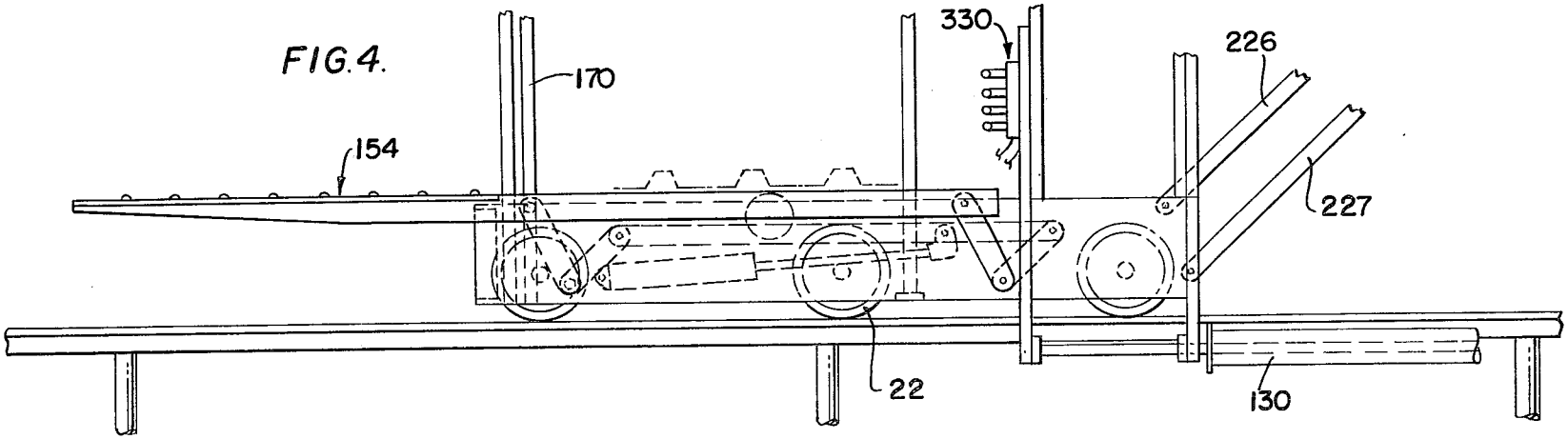
FIG. 4 is a side elevation view of the work station embodying the teachings of the present invention with an outrigger arm in a raised position.

The outrigger arms are identical, and accordingly, only one arm need be described. Arm 88 and the associated elevator linkage 92 are best shown in FIGS. 3 and 4. The elevator linkage includes a fore bell crank 270 pivotally connected to fore-end 272 of the lever arm 106 and pivotally mounted on skirt 228 by a pivot pin 274 located at the connection of arms 276 and 278 of the fore crank. The fore crank is also pivotally connected by a pin 280 located at another end of the crank to a push beam 284.

An aft bell crank 290 has one end of a first member 291 pivotally connected to the arm 106 by a pin 292 and has a pin 294 connecting the arms 291 and 295 of the crank 290 together, and arm 295 pivotally to the skirt 228. A further pin 296 pivotally connects arm 295 of the aft crank 290 to the aft end of the push beam 284. A coupling member 300 connects the push beam 284 to the ram 310 of a hydraulic cylinder 312 between the ends of the push beam. The hydraulic cylinder 312 is pivotally mounted by a pin 314 and a bracket 316 to the skirt 228. The pivotal connections and the members transform the rectilinear motion of the ram 310 into circular motion of the bell cranks, which cause the elevator arm 106 to tilt upward or downward in a circular path. The lower position of the arm and the associated elevator mechanism is shown in FIG. 3, and the raised position, with the ram 310 fully extended causing the push beam to rotate the bell cranks into an inverted orientation, is shown in FIG. 4. The arms are in the lower position in FIG. 2 also. Thus, the circular motion enables the outrigger arms to move material from the purlin tops to a location over the platform, as discussed.

A control center on the work station includes a control mechanism 330, best shown in FIGS. 3 and 4, which includes appropriate means as buttons, levers, or the like, for controlling movement of the work station, the outrigger arms and/or the insulation handling mechanism and the stretcher arms associated therewith. The control 330 can also be completely self-contained, i.e., have its own power source, or be connected to a ground located power source, and the control center is situated in any suitable location on the work station, or at various stations, as is convenient.

Because of the great variation in building widths, an alternative form of the present invention would include several units ganged together in a side-by-side relationship to cover the entire building. Such an alternative construction of the work station includes collapsible fences on the aft end and only one side of the work station. Such a station can be used in conjunction with another station, and/or other work machinery located adjacent thereto. Of course, the work station located adjacent the just-mentioned modified form of the work station would be altered so that the two stations could work in side-by-side relationship. For example, the second work station might have the insulation handling apparatus omitted, or have the wheels on one side offset so the station could be located next to the first station. The safety fences could also be modified so that the second station has the fences on the side located immediately adjacent the other station clear of the working area formed by the combined platforms. To accomplish such a result, the side fences of both stations could be folded into a location beneath the platforms, or even be removable from the platforms, in which case, the brackets 174 would, themselves, be removably mounted by further fastening means. A further element, such as a cross member, could be supported to span the area between the two work station platforms to produce a continuous work area surface. Such a spanner would have suitable cutout areas to enable the elevating means to move, or alternatively, the adjacent elevating mechanisms could be disabled so that only the outside located elevating means are operative in the side-by-side arrangement.

Having described the elements comprising the work station, the operation of that station will now be set forth in detail.

The work station can be placed onto a building roof either piecemeal or as an entity by a crane. The roofing materials, i.e., roofing panels, insulation, attaching means, or the like, can be hoisted to the roof and deposited in a central location by any suitable means. The work station is then moved into a position adjacent the roofing materials by an operator. The safety fences are lowered, the outrigger arms lowered beneath the plane of the purlin tops. The station is then moved to position the outrigger arms beneath the materials, and the arms actuated to lift the materials from the purlin tops to a position over the work platform 50. It is here noted that the materials could have been loaded directly onto the outrigger arms if one load is sufficient to complete a job. The workman can then move onto the platform, raise the fences, and move the materials from the outrigger arms as necessary. The work station is moved to a working location, and upon reaching the work location, insulation can be unwound from the insulation roll supported on roller 128. The insulation is wound about guide roll 130 as shown in FIG. 2 and over the purlin tops, as also shown in FIG. 2.

The stretcher arms can be lowered to stretch the insulation while that insulation is secured to the purlin tops, or, a roof panel can be lowered onto the stretcher arms, and the stretcher arms then lowered to lower the roof panel into position over the insulation while stretching that insulation into a taut configuration. The panel can then be secured to the purlins by men supported on the platform of the work station. It is noted that the men never have to leave the platform and the safety fences never have to be lowered. Therefore, the men are always supported on a secure and enclosed surface. Furthermore, the thus secured insulation is held in a very tight manner, as it has not had a chance to slacken between the time it is initially placed over the purlins and the time it is secured thereto. Furthermore, wind gusts will not loosen the insulation before the panel is secured thereon. The insulation is suitably severed and secured to the purlins in the usual manner.

Once the roof panel is in place, the moving work station is ready to be moved to the next position. The stretcher arms 152 and 154 are raised slightly to free them from the insulation, and the work station is backed up until the arms are completely free of the just-positioned panel. The stretcher arms can then be again raised into a panel accepting position and the work station repositioned at the next work location.

The process is repeated, with the work station moving backwards until a panel row is completed.

As a further step, rails can be placed on top of a secured panel, and the work station driven up onto those rails after it has been freed of the just-secured panel. The rails can be attached to the major corrugation and flat area of the panel system. The work station can then travel backwards, then up onto a rail. In this manner, those panels immediately adjacent a barrier or at the end of a roof can be secured using the work station. Thus, the work station can serve as a support for men finishing the roofing, or as a safety station in the event it is needed.

The work station can then be dismantled, or moved off of the roof as an entity by a crane.

It is noted that the above-discussed method is merely exemplary, and steps can be substituted and/or rearranged without departing from the teachings of the invention. It is also noted that the power sources for the moving station and/or the elements thereof can be electric, internal combustion, hydraulic, or any other suitable form.

The work station elements are preferably formed of aluminum, and the station preferably stands approximately 30 feet. The preferred form of the station can carry any number of roof panels, but a number less than 30 is preferred, and the panels are preferably, but not necessarily, less than 40 feet long. Of course, the work station platform, and other supporting elements, must be sufficiently strong to withstand the loading to which they will be subjected.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A device for use in constructing a building roof, comprising:

a work platform for supporting workmen and work materials, said work platform having a central work area;

a drive means on said platform for moving said platform along roof purlins;

material handling means on said platform including first and second pairs of movable arms attached to said platform to extend outwardly from said work platform so that material is supported on said arms outside of said central work area with said first pair of arms extending forwardly of said work platform and said second pair of arms extending rearwardly of said platform;

moving means connecting said arms to said platform and moving said arms upwardly and downwardly with respect to said platform; and protective fences on said platform.

2. The device of claim 1, wherein said material handling means includes insulation handling means.

3. The device of claim 1, further including control means for controlling movement of said work platform and for controlling said material handling means.

4. The device of claim 1, further including immobilizing clamps on said platform for releasably holding said platform on said roof purlins.

5. The device of claim 2, wherein said material handling means further includes work stretcher arms for maintaining the insulation in a taut condition.

6. The device of claim 1, further including mechanical linkages for elevating said arms upward from a location adjacent said platform to a location above said platform.

7. The device of claim 1, wherein said fences are collapsible.

8. The device of claim 6, further including a hydraulic motive means for moving said arms.

9. The device of claim 1, further including a winch on said platform for moving material onto said platform.

10. The device of claim 1, wherein said drive means includes wheels adapted to ride on roof purlins, one of which is a drive wheel, a motor on said platform for driving said drive wheel, and means connecting said motor to said drive wheel.

11. The device of claim 1, wherein said protective fences include fences located on at least two sides of said platform.

12. The device of claim 7, wherein said fences include standards attached to said platform, horizontal members pivotally attached to said standards, and couplings for connecting horizontal members together.

13. The device of claim 12, further including means for pivotally connecting said standards to said platform.

14. The device of claim 6, wherein said linkages include a push beam, a pair of bell cranks each connected to an end of said beam, means pivotally connecting said bell cranks to said platform, and means for moving said push beam.

15. The device of claim 5, wherein said insulation arms are adapted to assume a rest position beneath the plane of the purlin tops.

16. The device of claim 15, wherein said insulation stretcher arms are adapted to handle material.

17. The device of claim 1, further including anti-skid devices on said platform.

18. The device of claim 2, further including a guide roll on said insulation handling means.

19. The device of claim 1, wherein said fences are located completely around the periphery of said platform.

20. The device of claim 1, wherein said fences are stored on the sides of said platform.

21. A method of constructing a roof, including the steps of:

providing a moving work station;

locating roofing materials on top of the roof;

moving working materials onto the work station;

moving the work station to a work location;

positioning insulation on top of the roof purlins;

maintaining the insulation in a taut configuration;

locating a roof panel on top of the taut insulation;

securing the roof panel to the roof purlins; and moving the work station to the next location.

22. The method of claim 21, further including a step of erecting means for preventing workmen from falling off of the work station.

23. The method of claim 21, further including steps of laying rails on top of secured roof panels and moving the work station on top of the secured roof panel via the rails.

24. The method of claim 21, further including a step of releasing the insulation after the roof panel is secured in place.

* * * * *